US005771825A

United States Patent [19]

Degen et al.

[11] Patent Number: 5,771,825

[45] Date of Patent: Jun. 30, 1998

[54] EMBROIDERY MACHINE WITH AUTOMATIC THREAD CHANGER

[75] Inventors: Manfred Degen; Ludwig Günther, both of Chemnitz; Hans-Jürgen Heinrich; Roland Thiemer, both of Röhrsdorf; Franz-Josef Haffmans, Geldern; Willibert Nüsser, Linnich; Manfred Weidlich, Krefeld; Peter Wiemer, Meerbusch, all of Germany

[73] Assignee: ZSK Stickmaschinen GmbH, Krefeld-Gartenstadt, Germany

[21] Appl. No.: 721,315

[22] Filed: Oct. 15, 1996

[30] Foreign Application Priority Data

Oct. 13, 1995 [DE] Germany ..... 195 38 044.4

[51] Int. Cl.[6] ..... D05C 11/00

[52] U.S. Cl. ..... 112/80.7; 112/302; 112/475.18

[58] Field of Search ..... 112/78, 80.7, 98, 112/102.5, 302, 475.18, DIG. 3

[56] References Cited

U.S. PATENT DOCUMENTS

| | | | |
|---|---|---|---|
| 418,909 | 1/1890 | Cornely | 112/78 |
| 3,670,672 | 6/1972 | Spanel et al. | 112/80.7 X |
| 5,056,444 | 10/1991 | Lowry et al. | 112/98 X |

FOREIGN PATENT DOCUMENTS

| | | |
|---|---|---|
| 600 297 A2 | 6/1994 | European Pat. Off. . |
| 18 06 373 B2 | 9/1969 | Germany . |
| 30 28 413-A1 | 3/1981 | Germany . |
| 43 31 553-A1 | 3/1995 | Germany . |

OTHER PUBLICATIONS

Patent Abstracts of Japan re published application 06–287 854–A of 11 Oct. 1994.

Derwent WPI abstract of JP 06–287 854–A.

*Primary Examiner*—Ismael Izaguirre

*Attorney, Agent, or Firm*—Milton Oliver; Ware, Fressola, Van Der Sluys & Adolphson LLP

[57] ABSTRACT

The invention relates to an embroidery machine for embroidering embroidery fabric (23), particularly for chain stitching and drop stitching. The embroidery machine has an embroidery head (1), located above the embroidery fabric (23), and an embroidery needle (2) is movably supported in the embroidery head (1) in such a way that by means of drive mechanisms, the embroidery needle (2) is movable up and down and is also rotatable about its longitudinal axis. The embroidery machine also has a stitch plate (3), which is located below the embroidery fabric (23) and on which at least some of the embroidery fabric (23) rests during the embroidering. A thread layer (18) is located on the side of the stitch plate (3) remote from the embroidery fabric (23) and guides the embroidery thread (10) for stitching, and by rotation of the thread layer (18) the embroidery thread (10) can be laid around the embroidery needle (2) that has pierced the embroidery fabric (23). A cutting tool (19, 20) is provided by means of which the embroidery thread (10) can be severed. On the side of the thread layer (18) remote from the embroidery fabric (23), a plurality of injector nozzles (8) that blow air are provided, and by means of the compressed air stream one embroidery thread (10) at a time can be inserted into the thread layer (18), and the injector nozzles (6) are movable relative to the thread layer (18) by means of a drive mechanism (9) in such a way that the respective blower opening **(24*a*) of an injector nozzle (6) is aligned with the opening of the thread layer (18) toward the injector nozzle (6)**.

31 Claims, 11 Drawing Sheets

EMBROIDERY MACHINE WITH AUTOMATIC THREAD CHANGER

FIELD OF THE INVENTION

The invention relates to an embroidery machine for embroidering embroidery fabric, particularly for chain stitching and drop stitching; the embroidery machine has an embroidery head, which is located above the embroidery fabric, and an embroidery needle is movably supported in the embroidery head in such a way that by means of drive mechanisms the embroidery needle is movable up and down and is also rotatable about its longitudinal axis. The embroidery machine also has a stitch plate, which is located below the embroidery fabric and on which at least some of the embroidery fabric rests during the embroidering. A thread layer that guides the embroidery thread to be used in stitching is located on the side of the stitch plate remote from the embroidery fabric, and by rotation of the thread layer the embroidery thread can be laid around the embroidery needle that has pierced the embroidery fabric. A cutting tool is provided, by means of which the embroidery thread can be severed.

BACKGROUND OF THE INVENTION

Such embroidery machines have been known for a long time. Embroidery machines embroider an embroidery fabric in accordance with a computer-specified program. The quality of an embroidery machine is judged by how fast and accurately the embroidery machine can reproduce the specified embroidery pattern. The speed is critical in determining the commercial value of the embroidery machine. Since embroidery patterns are usually multi-colored, different-colored threads must be stitched in the embroidery pattern. This means that for one embroidery pattern, the embroidery thread must be changed multiple times.

Currently used embroidery machines for chain stitching and drop stitching lack automatic thread changing systems. If the embroidery thread in conventional embroidery machines has to be changed, then first the embroidery thread most recently stitched is severed by a knife and then manually pulled out of the thread layer in the direction of the bobbin. After that, the embroidery thread of the color needed now is pulled manually through the thread layer by means of a thread retriever, which is a thin wire with a barb on one end, until the free end of the new embroidery thread comes to rest between the stitch plate and the embroidery fabric. To that end, the thread retriever is punched through the embroidery fabric and guided through the eccentric bore of the thread layer. On the side of the thread layer remote from the embroidery fabric, the embroidery thread is placed in the barb of the thread retriever and then pulled through the thread layer. The thread retriever must be passed through the embroidery fabric precisely at the point where the opening of the stitch plate that is aligned with the eccentric opening of the thread layer is located. Since this opening in the stitch plate is not visible from the side of the embroidery head, changing threads is usually a very difficult and time-consuming operation. Often the embroidery fabric is also relatively large in size, since a plurality of embroidery patterns are stitched on the embroidery fabric at once by means of a plurality of parallel-arranged embroidery heads. Moreover, since the embroidery fabric cannot be moved while the thread is being changed, the person who is changing the thread must assume an uncomfortable posture to perform this difficult operation. The embroidery fabric is damaged in the process.

From European Patent application EP 0 600 297-A2, FURUSHITA et al., an automatic thread changing system for a sewing machine is known, in which a plurality of variously colored or different types of sewing threads can be delivered to a sewing needle automatically. The free ends of the sewing threads wound onto bobbins are each supplied to an air-blowing delivery nozzle, and the delivery nozzles are arranged in a circle around a main nozzle. If a particular thread is needed for sewing, then that sewing thread is blown by the associated delivery nozzle into the cone-shape opening of a funnel. From there, the sewing thread is blown through the funnel neck toward the sewing needle by means of the main nozzle. Additional thread guiding devices thread the particular sewing thread blown through the neck into the eye of the needle. This thread-changing apparatus has the disadvantage that the interplay of the delivery nozzles with the main nozzle is complicated, expensive and vulnerable to malfunction. Another problem is that the insertion openings of the delivery nozzles are relatively close together, so that threading the sewing threads into the delivery openings requires great manual skill. Also, the number of sewing threads and thus of possible sewing colors is limited by the maximum number of delivery nozzles that can be distributed along the circle around the opening of the funnel.

SUMMARY OF THE INVENTION

An object of the invention is therefore to furnish a color changing system for embroidery machines which is simple in design and in which the number of interchangeable colors or various types of embroidery threads can easily be increased.

This object is achieved according to the invention in that, on the side of the thread layer remote from the embroidery fabric, a plurality of injector nozzles that blow air are provided; by means of the compressed air stream, one embroidery thread at a time can be inserted into the thread layer, and the injector nozzles are movable relative to the thread layer by means of a drive mechanism in such a way that the respective blower opening of an injector nozzle is aligned with the opening of the thread layer toward the injector nozzle. By means of the embroidery machine of the invention, the change of embroidery thread is performed automatically by the embroidery machine. Markedly less time is needed for changing the embroidery threads than when the thread is changed manually, and thus a variously-colored embroidery pattern can be finished in less time.

Advantageously, in this version, only one air nozzle per embroidery thread is needed, and as a result the expense for engineering and material is relatively low. The version according to the invention is also especially advantageous because it entails little expense for control. Because it is embodied so simply, the embroidery machine of the invention is highly reliable in function and has little vulnerability to malfunction, making the commercial value of the embroidery machine quite high.

An especially simple structure of the thread delivery device for the thread layer is obtained if the injector nozzles are arranged in a row or in a grid, and in particular in a matrix. To that end, the injector nozzles can be secured to a carrier, and the carrier is movable in at least one direction by means of at least one drive mechanism, in particular a servomotor or stepping motor, or via a stepping gear, or a hydraulic drive.

To allow the carrier to have to be moved in only one or two directions, when the injector nozzles are arranged in rows or in a grid, so as to move the blower opening of whichever injector nozzle is advanced so that it is in alignment with and below the opening of the thread layer, the blower openings of the injector nozzles are advantageously located in the same plane.

It is also advantageous if all the injector nozzles are embodied identically, making them are easily interchangeable; in particular, the injector nozzles can be secured releasably to the carrier, for instance by means of a screw or snap connection or a dovetail connection. The carrier may be embodied such that a large number of injector nozzles can be secured to it. As needed, or in other words depending on the number of threads required for the embroidery pattern, correspondingly many injector nozzles are secured to the carrier. A releasable connection also enables easy maintenance of the injector nozzles. It is also conceivable, however, for the injector nozzles to be permanently connected to the carrier.

Each injector nozzle has one blower tube that forms the blower opening of the injector nozzle. A suction tube protrudes by one end part way into the opening of the blower tube remote from the thread layer. The outside diameter of the suction tube is advantageously smaller than the inside diameter of the blower tube, so that air can flow on the outside past the suction tube into the blower tube. Both the suction tube and the blower tube are held by a nozzle base body; the nozzle base body rests sealingly on both the outer jacket face of the suction tube and also on the outer jacket face of the blower tube, and between the sealing bearing faces forms a chamber into which air can be blown by means of a conduit. The chamber extends over a portion of the suction tube, and communication exists between the interior of the blower tube and the chamber. To that end, the nozzle base body rests on the outer jacket face of the blower tube as far as the opening remote from the thread layer of the blower tube. There is a connection between the interior of the blower tube and the chamber, since the outside diameter of the suction tube, at least in the inlet region of the suction tube, is smaller than the inside diameter of the blower tube. The injector nozzle thus comprises only three parts, which are simple to manufacture.

The conduit, which ends in the chamber of the injector nozzle, communicates with a compressed air tank, and compressed air can be blown intermittently into the conduit by means of a controllable valve located between the conduit and the tank. The air flowing into the chamber of the injector nozzle flows past the suction tube into the blower tube and generates a negative pressure in the suction tube, as a result of which an embroidery thread, or the end thereof, located in or upstream of the suction tube is aspirated in the direction of the thread layer.

As soon as the embroidery thread or its end leaves the suction tube, it is entrained by the air stream and blown out of the blower tube.

So that the highest possible suction can be generated, the inside diameter of the suction tube should be chosen to be as small as possible. However, care must be taken that the inside diameter of the suction tube is only slightly larger than the diameter of the embroidery thread, so that the embroidery thread can pass through the suction tube without difficulty and without major friction loss.

Since conventional modern embroidery machines make up to 1000 stitches per minute, the high transport speed and the attendant forces of acceleration can cause thread breakage. This breakage must be detected immediately by the embroidery machine, so that after the breakage has been corrected the pattern will be embroidered all the way to the end and there will be no missed stitches or, in other words, no stitch will have been left out.

To detect thread breakage early, means for monitoring the embroidery thread are located upstream of the opening of the suction tube remote from the blower tube. In an especially simple embodiment, the monitoring means has a pivotable bail, which can be pivoted or deflected out of its position of repose by the embroidery thread. The bail always seeks to pivot into its position of repose, or in other words its stable position. This can be effected by the force of a spring or by its own weight, and to that end, the bail is suitably supported rotatably. In its position of repose, the bail exerts pressure on a bearing point, and an embroidery thread located between the bail, in its position of repose, and the bearing point is held in its position by the contact pressure of the bail.

The weight of the bail or the force exerted by the spring on the bail is dimensioned such that the embroidery thread, held in position by the bail, pivots the bail out of its position of repose as soon as the embroidery thread by means of the injector nozzle has been aspirated by the suction tube or been blown out of the blower tube or stitched, or in other words is under tensile strain.

Advantageously, by means of a sensor the position of the bail is ascertained and transmitted to the controller of the embroidery machine. If the controller of the embroidery machine ascertains that the embroidery thread has been torn, then the embroidery machine is immediately stopped, and the operator or operators are so informed by an alarm.

In order to furnish the length of thread required to start embroidering after a change of thread, a thread draw-off device is provided, by means of which the embroidery thread can be drawn from a bobbin. In addition, located between the thread draw-off device and the bobbin is at least one thread tensioner, by means of which the embroidery thread can be clamped with a predeterminable contact pressure, such that the embroidery thread can be drawn through the thread tensioner only beyond a certain tensile force. To that end, the thread tensioner has two tension disks, between which the embroidery thread is guided. The tension disks are pressed against one another by means of a spring, and by means of an adjusting mechanism, the spring force can be cancelled, such that the embroidery thread guided between the tension disks is not pressure-actuated by the tension disks; that is, it can be drawn through the thread tensioner virtually without friction and without the exertion of force.

It has proved to be especially favorable if between the thread draw-off device and the bottom there are two thread tensioners, the first thread tensioner, by means of its tension disks, always holds the embroidery thread with an adjustable contact pressure, and in the case of the second thread tensioner, by means of an adjusting mechanism, the spring force can be cancelled, such that the embroidery thread guided between the tension disks is not pressure-actuated by the tension disks.

Advantageously, the thread draw-off device has a draw-off bail, pivotable into predeterminable positions, and on pivoting out of its outset position the draw-off bail draws the embroidery thread from the bobbin in accordance with the pivoting motion. The draw-off bails are supported rotatably on a shaft and are pivotable each individually by means of a single drive mechanism. The drive mechanism is not moved along with the carrier to which the injector nozzles are secured but instead is stationary relative to the embroidery head.

According to the invention, the thread draw-off device is additionally used to pull the embroidery thread, severed from the embroidery fabric by the cutting tool, out of the thread layer. To that end, the embroidery thread is arrested by means of the thread tensioner, and by the pivoting motion of the draw-off bail of the thread draw-off device, the end of the embroidery thread which is connected to the embroidery thread wound onto the bobbin is then pulled out as far as the blower opening of the injector nozzle. Thus two functions (monitoring and clamping of the embroidery thread) are performed by a single device. This is possible as a result of the cooperation of the thread monitor, the thread draw-off device, and the thread tensioner.

In a preferred embodiment of the invention, each injector nozzle is assigned precisely one valve, one monitoring means, one thread draw-off device, at least one thread tensioner, and one bobbin holder. The injector nozzles, the monitoring means, the thread tensioner and the bobbin holder are secured on a carrier. This carrier is movable by the drive mechanism relative to the thread layer in such a way that each injector nozzle is selectively aligned with and beneath the thread layer. An embodiment according to the invention that is especially simple both technologically and structurally is obtained if the sensor for detecting the position of the bail of the monitoring means is stationary relative to the thread layer. As a result, advantageously only one sensor is needed for all the injector nozzles, and the sensor ascertains the position of the bail that belongs to whichever injector nozzle has moved into alignment with the thread layer.

According to the invention, each valve, by means of which the air stream of an injector nozzle is controlled, is controllable individually, automatically and/or manually. The valve is controlled on the one hand by the controller of the embroidery machine, but can also be adjusted into the open or closed position by means of a manually actuatable signal-producing means, especially a switch.

If the valve is manually controlled, then the valve opens for a presettable time. This presettable time is independent of the length of time taken for manual actuation of the signal-producing means. The effect attained is that the end of the embroidery thread which has been brought manually, for instance, into the vicinity of the aspiration opening of the suction tube of the injector nozzle, needs to be blown only as far as the region of the blower opening of the injector nozzle, for instance. If the embroidery thread end is in the region of the blower opening of the injector nozzle, then the injector nozzle is now fully equipped and is in the readiness position. In the readiness position, an automatic thread change can be performed by means of the nozzle.

As a result of the actuation of the signal-processing means, a signal is set to the embroidery machine controller, which controls the valve in accordance with the previously programmed-in sequence. The programming can advantageously be done such that if actuation of the means takes longer than the preset time, then this situation is detected, and from that moment on the valve remains open until the signal-actuating means is no longer actuated.

If the embroidery machine should automatically ascertain a thread break that has occurred at some arbitrary point, then it is advantageous if additional detection sensors, in particular photoelectric gates, are provided which transmit a corresponding detection signal to the controller of the embroidery machine as soon as the embroidery thread is detected or not detected. These photoelectric gates may be provided wherever monitoring of the embroidery thread is necessary.

If a thread change becomes necessary because of the specified embroidery pattern, and assuming that no thread break is present, then advantageously the instantaneous stitched embroidery thread is drawn off from its bobbin to a predetermined embroidery thread length by the thread draw-off device, and the drawn-off embroidery thread length is equal to the length of the travel route from the cutting position C to the needle penetration position A. The drawing off of the required length of embroidery thread is effected by means of the draw-off bail of the draw-off device, the lever being deflected outward by a certain angle. This is necessary so that in the readiness position B then reached the loop of thread will be long enough, and the end of the thread when later blown into the thread layer will come to rest in the region of the needle penetration position A. Next, the embroidery thread that has just been stitched is severed by the cutting tool underneath the stitch plate. The end of the embroidery thread is then pulled out of the thread layer by means of the thread draw-off device. During this process, the embroidery thread is arrested by means of the thread tensioner. The end of the embroidery thread is now pulled out of the thread layer far enough that the end of the embroidery thread which is connected to the embroidery thread wound up onto the bobbin is located, after being pulled out, in the region of the blower opening of the injector nozzle (readiness position B). In a next step, the carrier on which the injector nozzles are secured is moved such that the opening of the particular injector nozzle in which the next embroidery thread to be stitched is located is in alignment with the opening of the thread layer. After that, the next embroidery thread to be stitched is blown into the thread layer by means of the associated injector nozzle in such a manner that the end of the embroidery thread passes through the opening of the stitch plate, which opening is in alignment with the eccentric opening of the thread layer, and this end of the thread is located between the stitch plate and the embroidery fabric, in the needle penetration position A. The thread change is thus concluded, and embroidering of the embroidery pattern can now be resumed with the newly inserted color or the newly inserted embroidery thread.

If a thread break has occurred, then the torn embroidery thread must be completely removed from the thread layer. This can be done manually or by means of the thread draw-off device. To put the injector nozzle in the readiness position B, in a first operating step, the embroidery thread is passed between the bearing point and the bail of the monitoring means, in such a way that the end of the embroidery thread is in the vicinity of the aspiration opening of the suction tube. After that, by means of the signal-producing means or switch, the valve of the associated injector nozzle is opened for a certain period of time, and by means of the air flowing into the injector nozzle, a negative pressure in the suction tube can be generated. As a result, the embroidery thread is aspirated into the suction tube and then is blown out of the blower tube by the air stream. Advantageously, the valve is opened until such time as the embroidery thread, with its end, has left the blower opening of the injector nozzle.

If the embroidery thread is broken beneath the cutting tool, then the protruding end of the embroidery thread, which has been stitched in the embroidery fabric, can be severed; after being cut, it slides downward by gravity out of the thread layer.

By means of the additional sensors, it is also possible to monitor where in the embroidery machine the end of the embroidery thread is located, such as in the injector nozzle, the thread layer or the thread draw-off device. This can be reported to the operator or operators. The automatic and therefore fast error diagnosis means that the operators need not make time-consuming searches for errors.

Several exemplary embodiments of the invention will be described in further detail below in conjunction with the drawings.

DETAILED DESCRIPTION OF THE PREFERRED EMBODIMENTS

Figure 1:
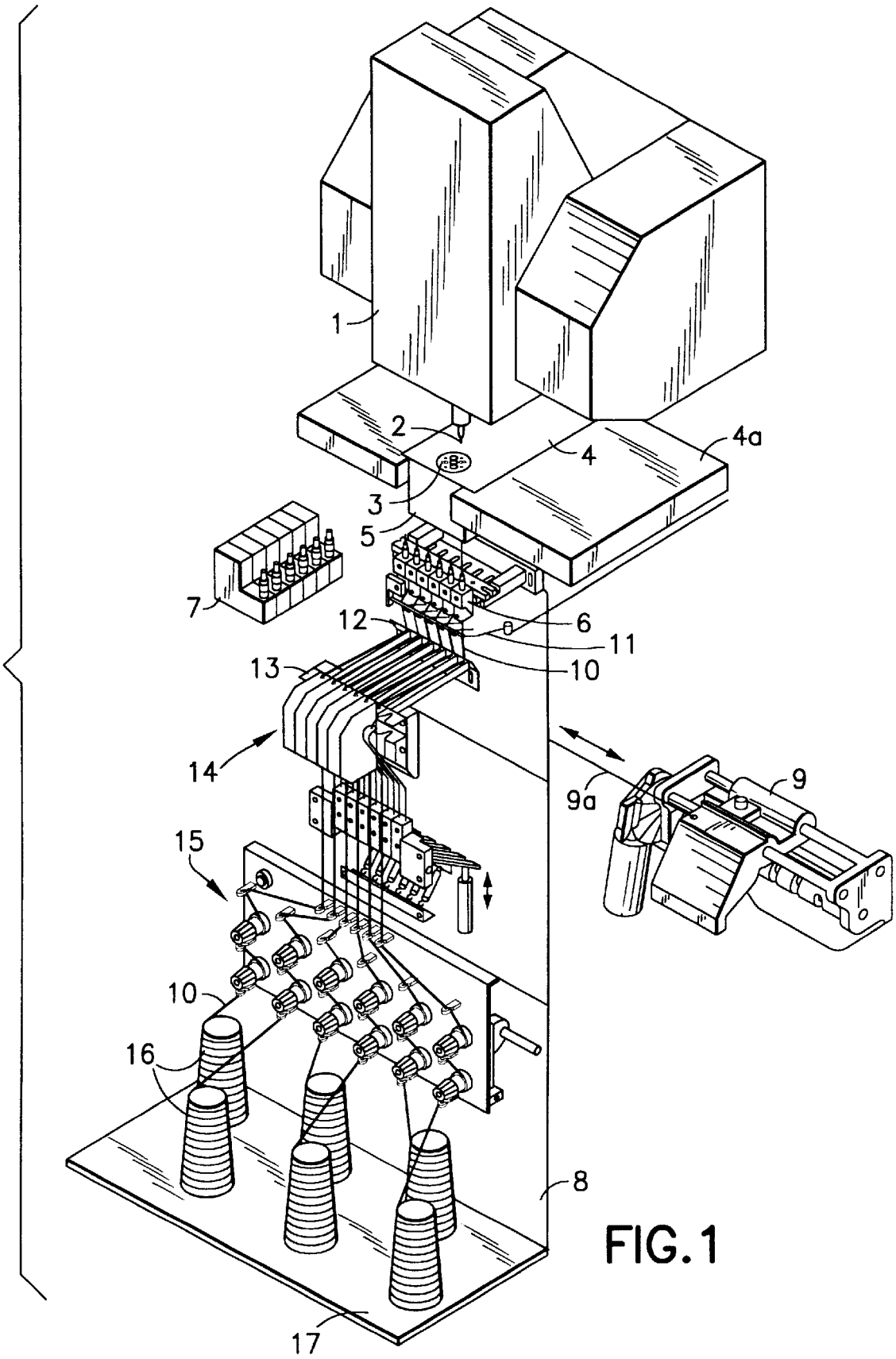
FIG. 1 shows a fragmentary view of an embroidery machine.

FIG. 1 is a fragmentary view of an embroidery machine. The embroidery machine has an embroidery head 1, which is secured to an upper carrier, not shown. The embroidery head 1 has drive mechanisms, not shown, for the embroidery needle 2, by means of which the embroidery needle 2 can be moved up and down and rotated about its axis. Below the embroidery fabric 23, not shown, is the embroidery foot 5, which is secured to a lower carrier, again not shown. The embroidery foot 5 is supported rigidly relative to the embroidery head 1, so that it is always assured that the embroidery needle 2 piercing the embroidery fabric 23 can plunge into the intended opening 3*a* in the stitch plate 3. To that end, the upper and lower carriers, not shown, of the embroidery machine are rigidly joined together. The foot plate 4 of the embroidery foot 5 is located in the countertop 4*a,* only part of which is shown.

Figure 2:
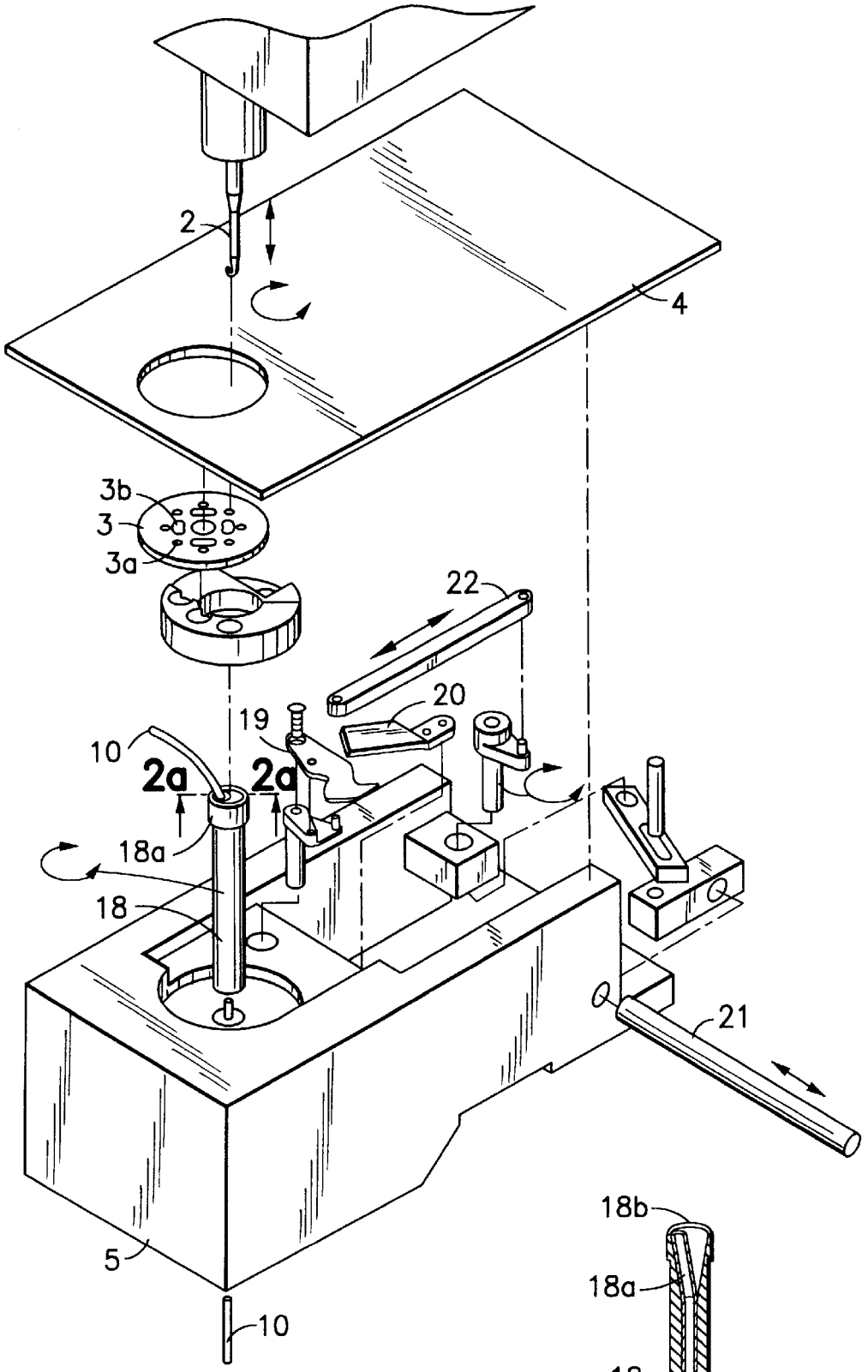
FIG. 2 is an exploded view of an embroidery foot.
Figure 2A:
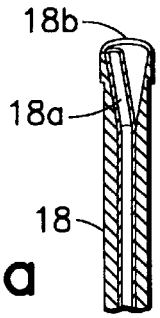

As can be seen from FIG. 2, a thread layer 18 is rotatably supported in the housing of the embroidery foot 5; by means of a drive mechanism, not shown, it is rotatable about its axis. A detail of the thread layer 18 is shown in FIG. 2*a*. It has a thread guide tube 18*a,* which is located centrally in the lower region and bent outward in the upper region of the thread layer 18. In the upper region, the thread layer 18 has a needle penetration opening 18*b* into which the embroidery needle 2 plunges after passing through the stitch plate 3. The embroidery thread 10 guided by the thread guide tube 18*a* in the thread layer 18 is placed, by rotation of the thread layer 18 about its longitudinal axis around the embroidery needle 2 that engages the needle penetration opening 18*b*. Once the thread layer 18 has placed the embroidery thread 10 around the embroidery needle 2 located in the needle penetration opening 18*b,* the embroidery needle is moved upward by its drive mechanism through the embroidery fabric 23; the hook located on the embroidery needle 2 engages the embroidery thread 10 that has been placed around the embroidery needle 2 and moves upward with it through the embroidery fabric 23.

Above the needle penetration opening 18*b* of the thread layer 18 is a knife 19, 20, which as needed severs the embroidery thread 10 just above the needle penetration opening 18*b*. For that purpose, the knife has two blades 19 and 20, the blade 20 being supported rigidly and the blade 19 rotatably. By means of a displaceably supported knife drive rod 21, the rotatably supported blade 19 is rotated in such a way that the embroidery thread 10 is clamped between the blades 19 and 20 and severed by their scissors action.

Below the embroidery foot 5, injector nozzles 6 are arranged in a row. By means of the injector nozzles 6, an embroidery thread 10 located in the respective injector nozzle 6 can be selectively blown through the thread layer 18 and the stitch plate 3 by means of compressed air. A thread monitor 11 is located below the injector nozzles 6, and by means of it constant monitoring of the embroidery thread 10 is done. At the same time, the thread monitor 11 serves to clamp the embroidery thread ends 10*a,* located in the injector nozzles 6 or protruding from their upper blower openings 24*a*, in such a way that the ends 10*a* do not slip out of the injector nozzles 6.

Figure 9:
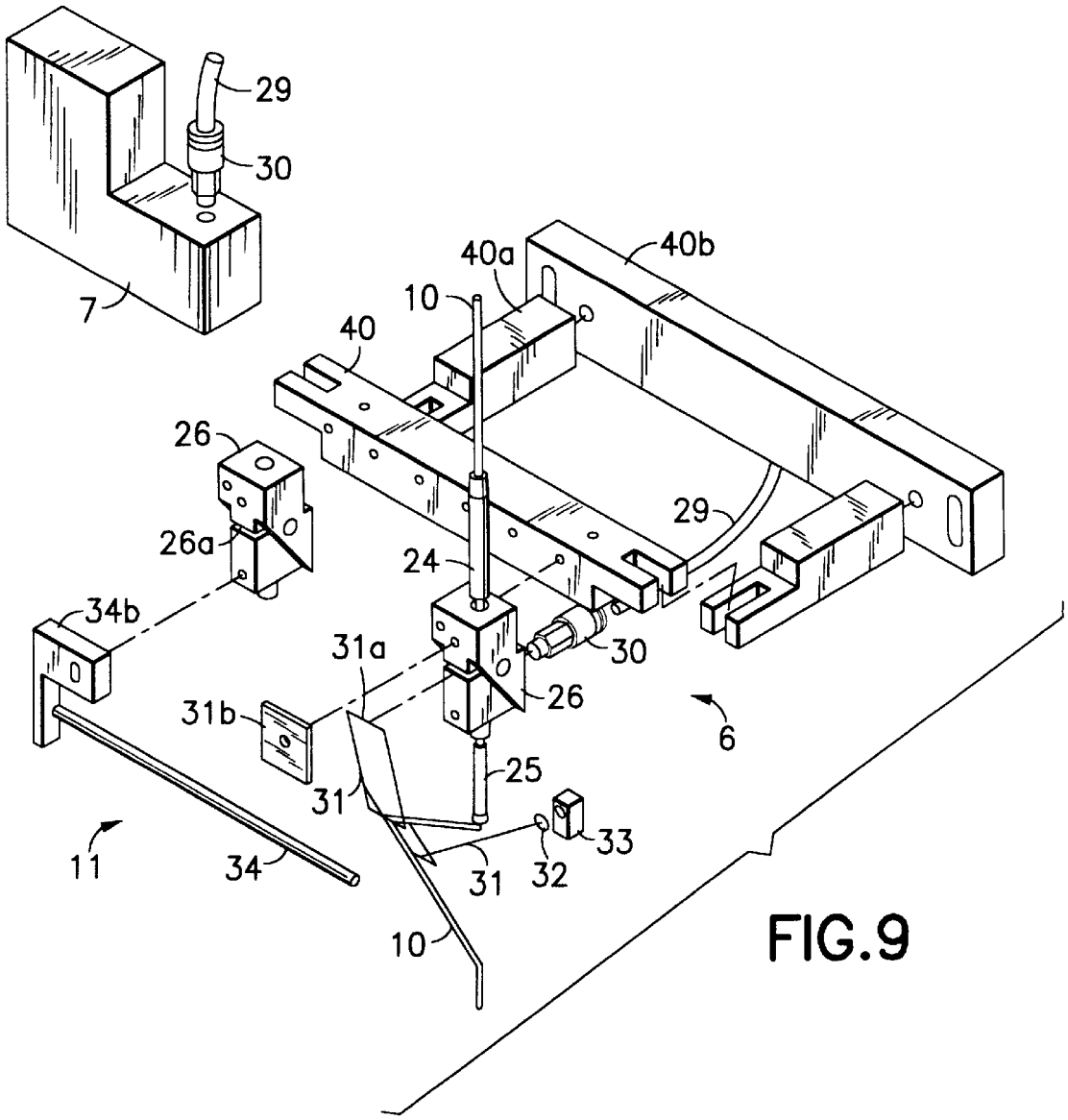
FIG. 9 is an exploded view of an injector nozzle with a thread monitor located beneath it.

The embroidery threads 10 drawn from the bobbins 16 are guided to the injector nozzles 6 via a thread tensioner 15 and a thread draw-off device 14. Additional thread guide strips 12 and 13 serve to guide the embroidery threads 10 parallel. The injector nozzles 6, as can be seen from FIG. 9, are each in communication, through a compressed air hose 29, with a compressor or compressed-air-dispensing pressure vessel, not shown. Between the compressor or compressed air vessel not shown, one valve 7 is provided for each compressed air hose 29, the valve being controllable manually or automatically by the embroidery machine controller. If the valve 7, which is preferably an electromagnet valve, is opened the compressed air 39 flows via the corresponding compressed air hose 29 to reach the injector nozzle 6.

Figure 3:
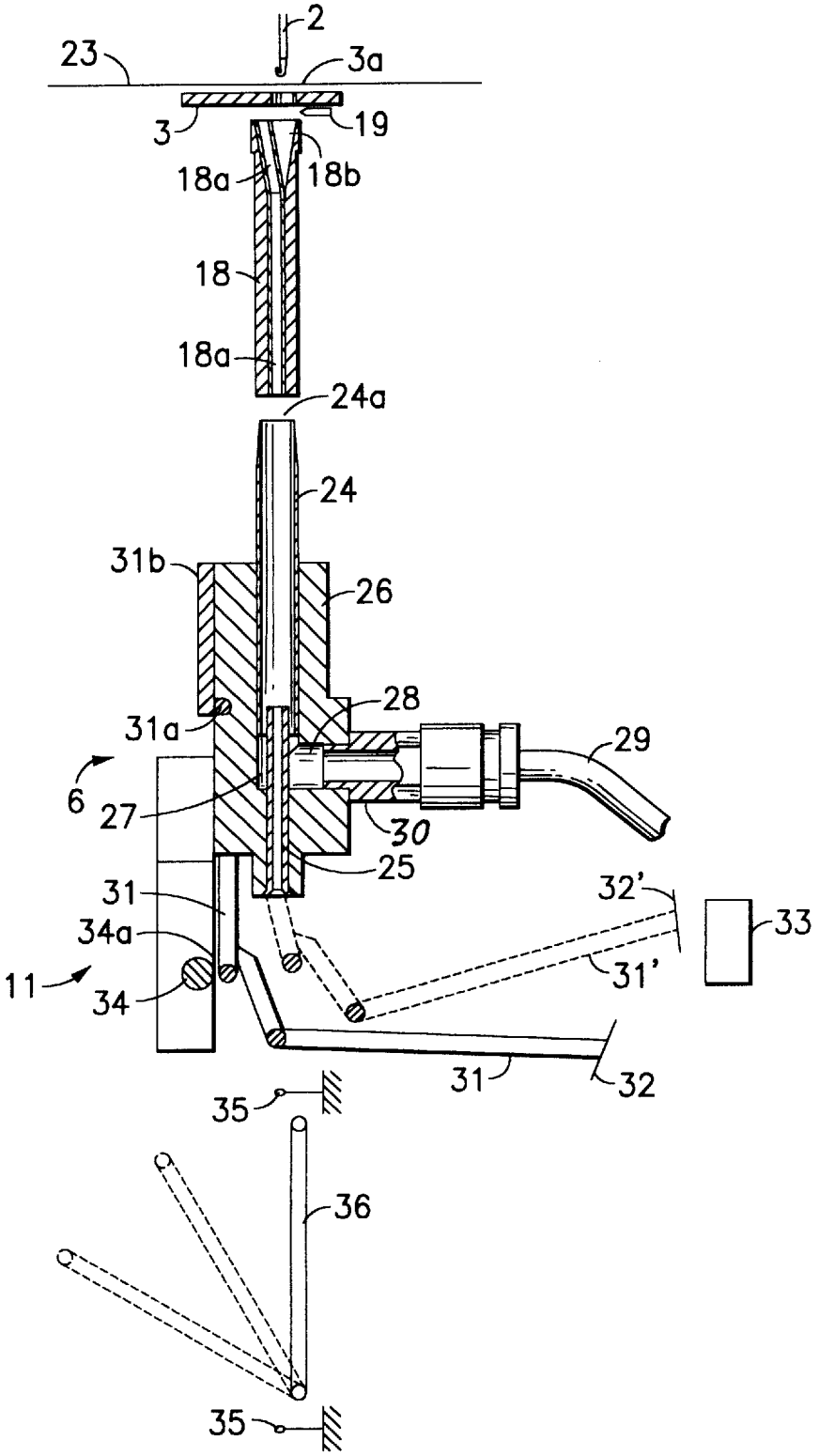
FIGS. 3–8 are cross-sectional views through an embroidery machine, in various thread positions.

As can be seen from FIG. 3, each injector nozzle 6 comprises one nozzle base body 26. This base body 26 has two bores of different diameter, located on the same axis. A blower tube 24 is located in the bore having the larger diameter; its blower opening 24*a* is movable by means of the drive mechanism 9 to alignment with and below the lower opening of the thread layer 18. On the side of the nozzle base body 26 remote from the thread layer, a suction tube 25 can be inserted into the bore intended for it, with the end of the suction tube 25 toward the thread layer protruding into the lower opening of the blower tube 24. The lower face end of the blower tube 24 forms one side face of the chamber 27 that partially surrounds suction tube 25. Via a conduit 28, compressed air can be blown into the chamber 27. To that end, the compressed air hose 29 communicates with the conduit 28 via a connection neck 30. Because the nozzle base body 26 rests sealingly against the outer jacket faces of the blower tube 24 and suction tube 25, a negative pressure is produced by the entering compressed air in the suction tube 25 that aspirates an embroidery thread 10, located below the suction tube 25, through the suction tube 25 in the direction of the thread layer 18. As soon as the embroidery thread end 10*a* has emerged from the suction tube 25, it is entrained by the stream of compressed air in the direction of the blower opening 24*a*. The focusing of the compressed air stream blows the embroidery thread 10 through the lower opening of the thread layer 18, and from there the thread reaches the stitch plate 3.

Figure 5:
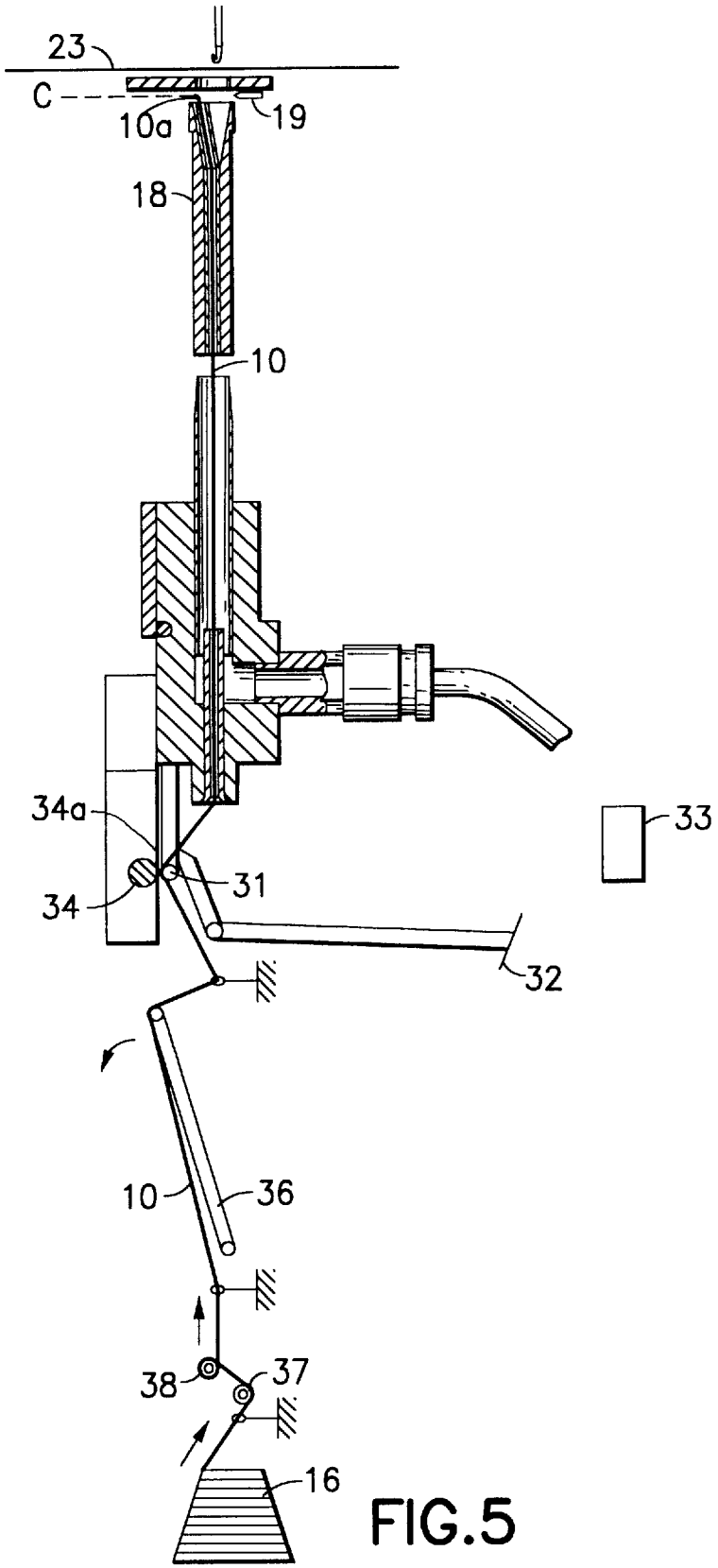
Figure 6:
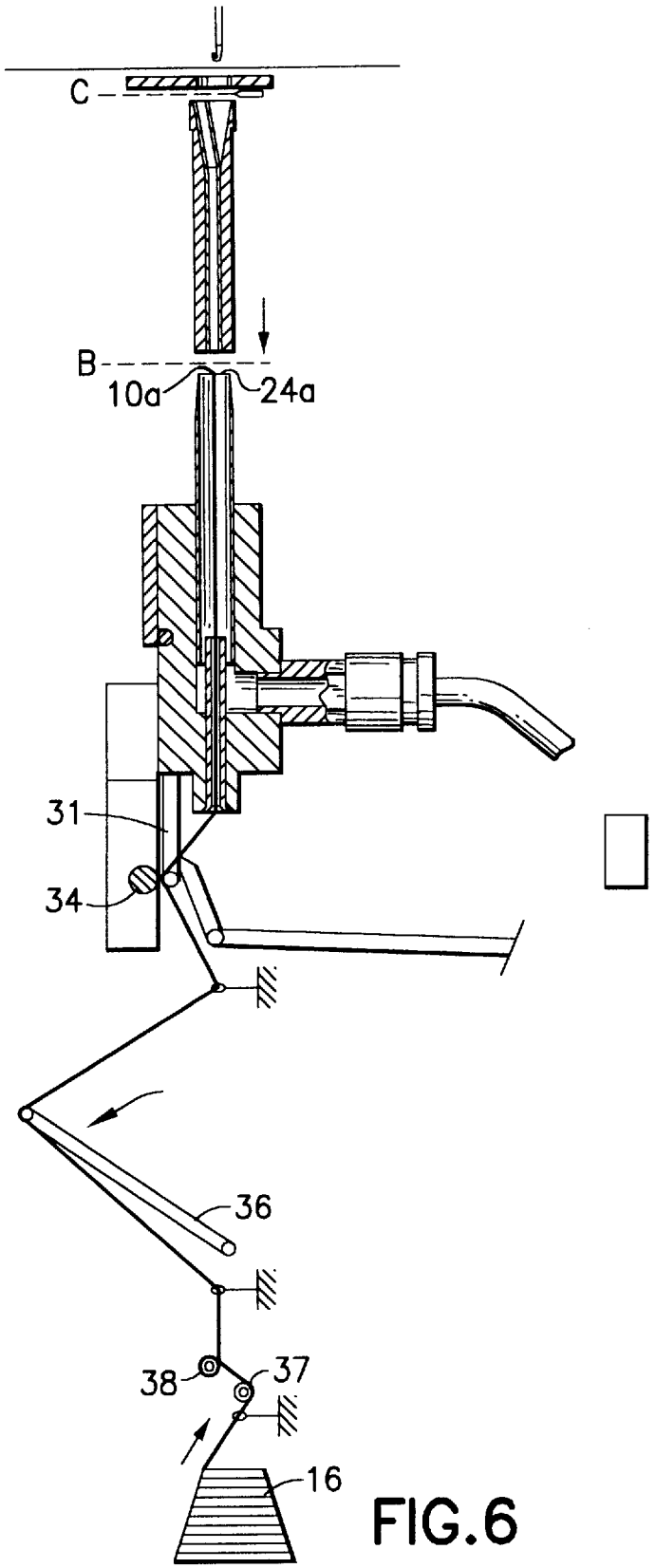

A bail 31 is pivotably connected to the nozzle base body 26 by means of the pivot joint 31*a;* the bail 31 rests in a recess 26*a* of the nozzle base body 26 and is rotatably retained by means of a bearing plate 31*b*. The bail 31, bent at an angle, is pressed by its own weight or by a spring, not shown, against a bearing rod 34. A mirror plate 32 is located on the end of the bail 31. The weight of the bail 31 is dimensioned such that an embroidery thread 10 under tensile strain, without itself being torn, pivots the bail 31 out of its position of repose. A bail 31' that has been pivoted in this way is shown in dashed lines in FIG. 3. As a result of the deflection of the bail 31', the mirror plate 32' is located in front of the sensor 33, which by way of example may be a photoelectric gate, comprising a lighting means and a photo detector. If the mirror plate 32' is located in front of the sensor or photoelectric gate 33, then the light emitted by the lighting means reaches the mirror plate 32', where it is reflected and detected by the photo detector. If the embroidery thread 10 is not under tensile strain from the embroidery needle 2 or the compressed air 39 of the injector nozzle 6, then the bail 31 pivots into or remains by its own weight in its position of repose, and as can be seen in FIGS. 5 and 6 clamps the embroidery thread 10 between itself and the bearing point 34*a* of the bearing rod 34. By means of a suitable surface roughness or surface shaping of the bearing rod 34 and bail 31, the embroidery thread 10 is prevented from sliding by its own weight out of the injector nozzle 6 or downward between the bearing rod 34 and bail 31.

A thread draw-off bail 36 is located below the thread monitor 11, as can be seen in FIG. 3; it is pivotable by means of a drive mechanism shown in FIG. 10. The thread draw-off bail 36 draws the embroidery thread 10 from the bobbin 16 to a certain thread length, or pulls the end 10*a* of the embroidery thread out of the thread layer 18 in the direction of the blower tube 24. A first thread tensioner 37 and a second thread tensioner 38 are located below the thread draw-off device 14. A plurality of thread guide eyelets 35 are located between the various devices and accordingly deliver the embroidery thread 10 to the particular device.

Figure 4:
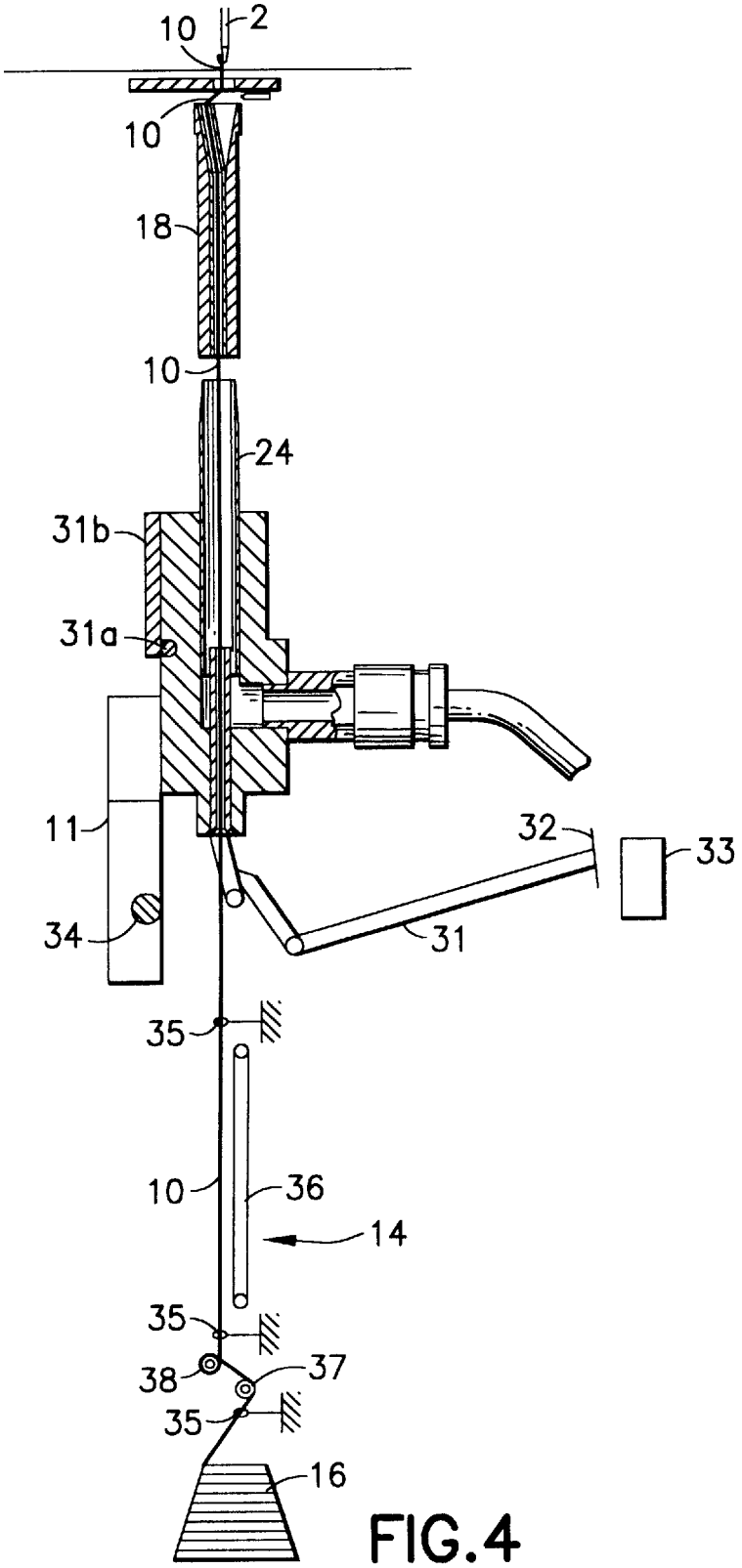
Figure 11:
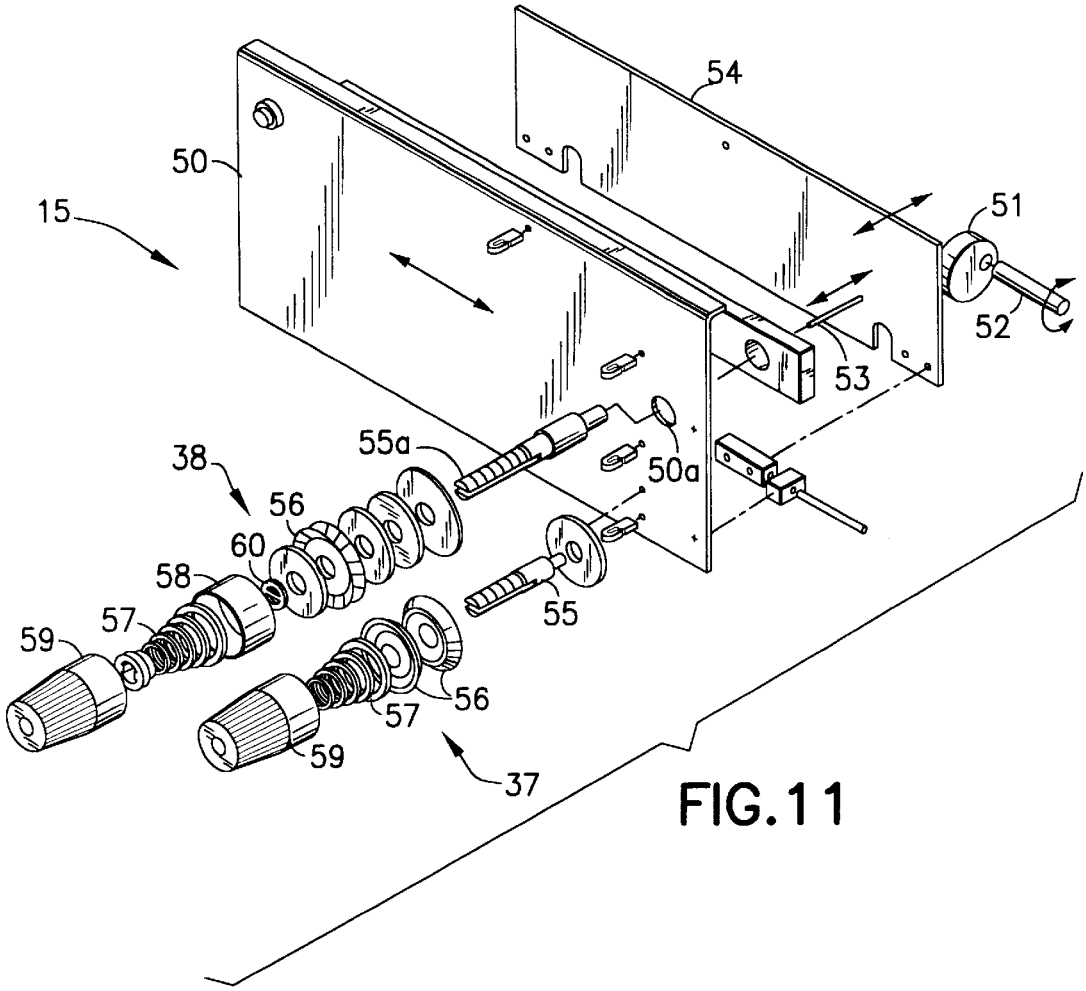
FIG. 11 is an exploded view of the thread tensioner.

FIG. 4 shows a simplified course of the embroidery thread. The embroidery thread 10 is guided from the bobbin 16 through a first guide eyelet 35 to the first thread tensioner 37, where the embroidery thread 10, as FIG. 11 shows, is clamped by means of two tension disks 56 with constant pressure. From the first thread tensioner 37, the embroidery thread 10 reaches the second thread tensioner 38. From there, the embroidery thread 10 passes via a further guide eyelet 35 to the thread draw-off device 14. If the embroidery thread 10 is put under tensile strain by the embroidery needle 2, then the bail 31 is pivoted, and the position of the bail can be transmitted to the embroidery machine controller by the sensor 33. Once the bail 31 remains in the deflected position, this signifies to the embroidery machine that the embroidery thread is not broken.

Figure 8:
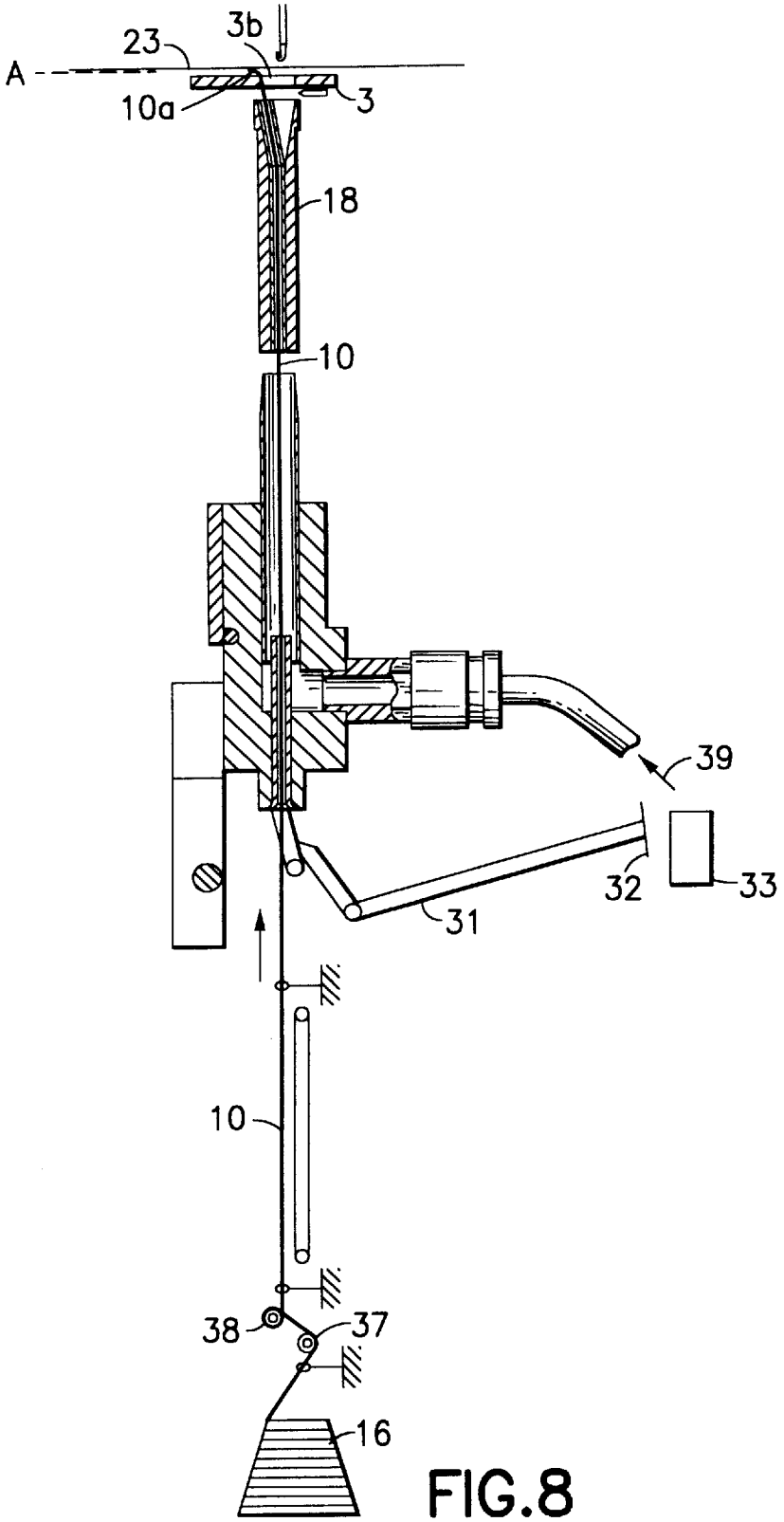

If a new embroidery color is needed for the embroidery pattern, then the embroidery needle 2 is first stopped. The end 10*a* of the embroidery thread is held by the embroidery fabric 23 and the embroidery needle 2 and prevented by them from being pulled in the direction of the bobbin 16 by the thread draw-off bail 36. A certain length of thread is drawn from the bobbin by pivoting the thread draw-off bail 36. The length of thread to be drawn off corresponds to the travel distance between the embroidery outset position A (FIG. 8) and the cutting position C. Next, with the aid of the knife or blades 19 and 20, the embroidery thread 10 is severed at C. As a result, the embroidery thread 10 loses its tensile strain, and the bail 31 by its own weight clamps the embroidery thread 10 between it and the bearing point 34*a* (see FIG. 5).

Figure 7:
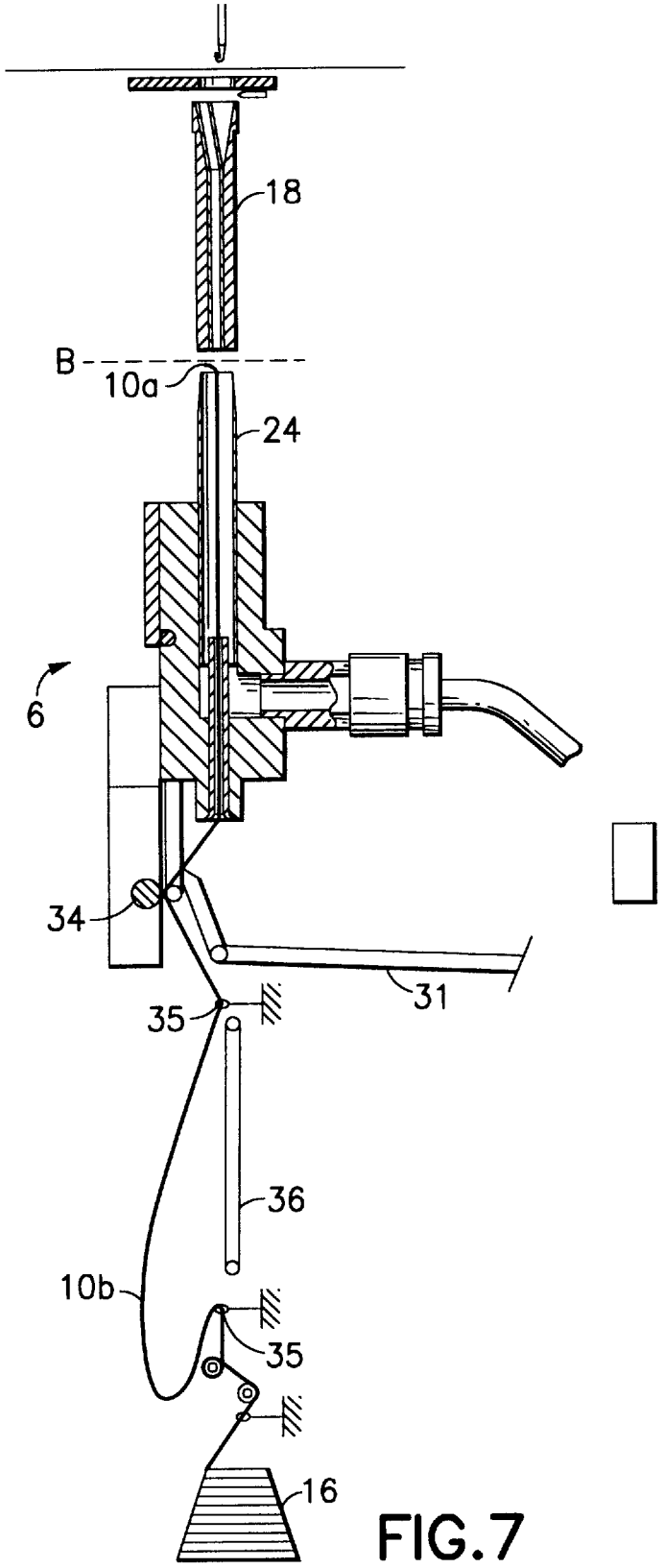

Next, by means of the second thread tensioner 38, the embroidery thread 10 is clamped in such a way that by means of a further pivoting motion of the thread draw-off bail 36 (FIG. 6), the embroidery thread 10 is pulled out of the thread layer 18; after one complete pivoting motion of the thread draw-off bail 36, the embroidery thread end 10*a* is located in the region of or in front of the outlet nozzle 24*a*. Next, as can be seen from FIG. 7, the thread draw-off bail 36 is pivoted into its outset position, and a result the embroidery thread 10 forms a loop 10*b* of embroidery thread between the two guide eyelets 35. The embroidery thread 10 of this injector nozzle 6 is thus located in the readiness position B. The drive mechanism 9 now moves the carrier 8 until the injector nozzle 6 which is holding in readiness the new color of embroidery thread to be furnished, is in alignment with the thread layer 18. The embroidery thread 10 of this new injector nozzle 6 likewise forms a loop 10*b* between the guide eyelets 35, the length of which loop is dimensioned such that the end 10*a* of embroidery thread, after being blown through the thread layer 18 and the thread guide hole 3*b* in the stitch plate 3, is located between the stitch plate 3 and the embroidery fabric 23 (position A). By means of the thread tensioner 15, the embroidery thread 10 is firmly clamped as it is blown in, so that on aspiration, no thread is drawn from the bobbin. Blowing the embroidery thread 10 into the thread layer 18 causes a tensile strain to build up that deflects the bail 31, so that the sensor 33 tells the embroidery machine controller that the embroidery thread 10 is in the embroidery outset position A. The stitching of the newly inserted or introduced embroidery thread 10 can now begin.

FIG. 9 shows an exploded view of the injector nozzle carrier 40, the injector nozzle 6, and the thread monitor 11. The nozzle base bodies 26 of the individual injector nozzles 6 are held next to one another on the injector nozzle carrier 40 by fastening screws, not shown. The injector nozzle carrier 40 is connected via spacers 40*a* to a carrier retention plate 40*b*, which in turn is secured to the carrier 8. The particular compressed air hose 29 that connects a given valve 7 and a nozzle base body 26 is connected to the valve 7 and the nozzle base body 26 by means of a suitable connection neck 30.

Each nozzle base body 26 has a recess 26*a*, in which the bail 31 rests with its top crosswise member 31*a*. By means of a bearing plate 31*b*, the crosswise member 31*a* is prevented from being able to slide out of the recess 26*a*. The recess 26*a* and the upper crosswise member 31*a* thus form a pivot joint. One mirror plate 32 is located on each lower end, bent at an angle, of the bail 31. The sensor 33, fixed opposite the embroidery head 1, monitors only the bail 31 of the associated injector nozzle 6 that has moved in alignment with its blower opening 24*a* under the thread layer 18. In an embodiment not shown, however, each bail 31 of each injector nozzle 6 may be monitored by its own sensor 33. Instead of mirror plates and photoelectric gates, other sensors may also be used, such as capacitive, inductive or Hall sensors.

A fastening part 34*b* is secured by fastening screws, not shown, to a nozzle base body 26. The bearing rod 34, which together with the bails 31 holds the embroidery threads 10 of the individual injector nozzles 6, as long as the embroidery threads 10 are not under tensile strain, is secured to the fastening part 34*b*.

Figure 10:
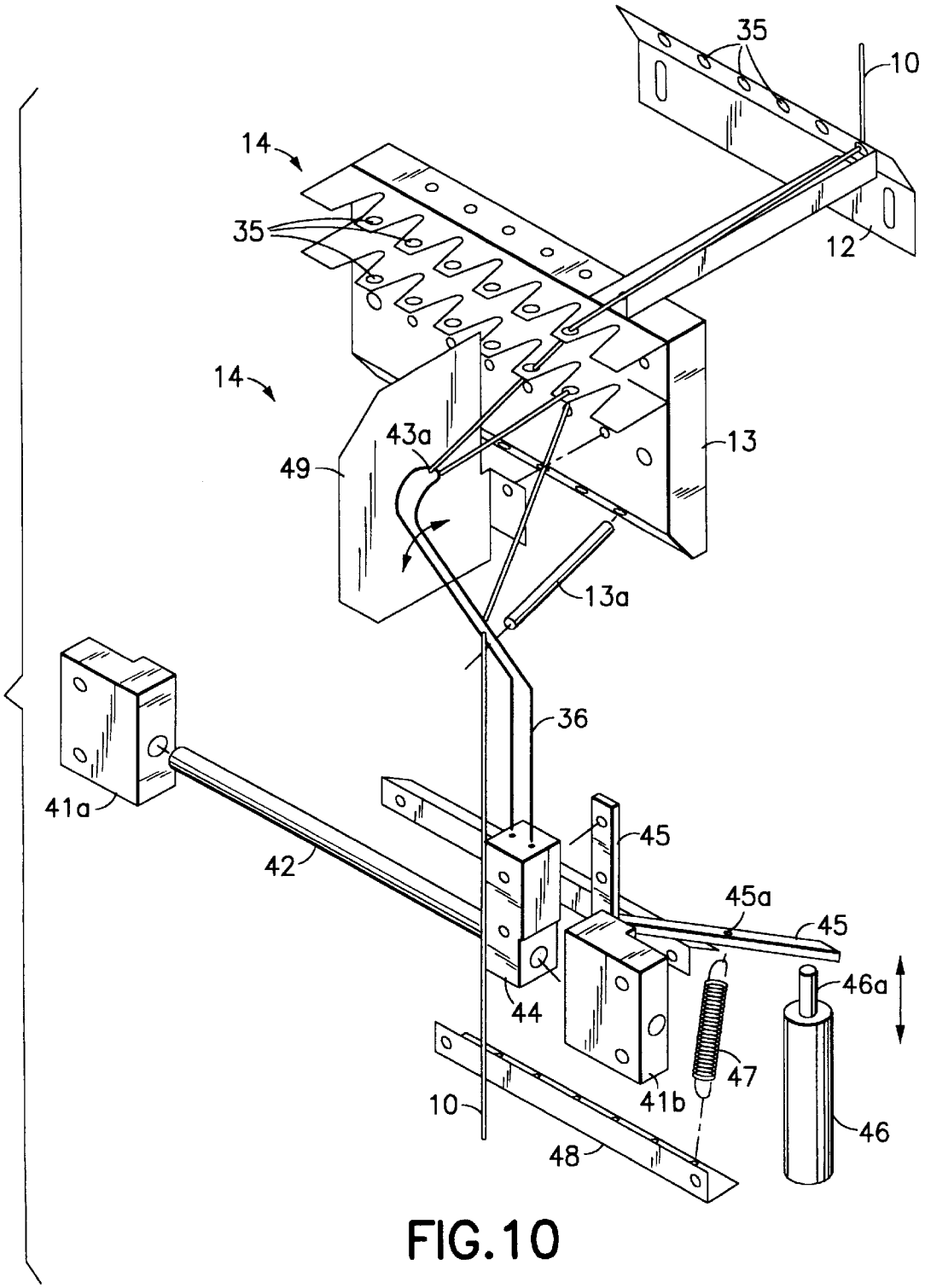
FIG. 10 shows a thread draw-off device with the embroidery thread threaded through it.

FIG. 10 shows the thread draw-off device 14, by means of which the respective stitched embroidery thread 10 can be drawn from the corresponding bobbin and by means of which the embroidery thread 10 can be pulled out of the thread layer. Each embroidery thread 10 passes from the bobbins 16, not shown, via a plurality of guide eyelets 43*a*, 35 to the thread monitor 11, also not shown. The thread draw-off bail 36 is supported in a bail holder 44. The bail holders 44 are rotatably supported on the shaft 42. The shaft is held on both sides by the bearings 41*a*, 41*b*. A lever 45 bent at an angle is secured to each bail holder 44 by means of fastening screws, not shown. By means of a tension spring 47, the lever 45 is pulled toward a retention plate, thus pivoting the thread draw-off bail 36 into its position of repose. As soon as the tappet 46*a* is forced out of the pneumatic cylinder 46, it exerts pressure on the lever 45 and the bail holder 44 and thus on the thread draw-off bail 36. By the motion of the thread draw-off bail, in accordance with the angle of deflection, the embroidery thread 10 is either pulled out of the thread layer 18 or drawn from the bobbin 16. Partitions 49 are located between the individual thread draw-off bails 36 so that the thread draw-off bails 36 cannot catch on one another. In addition, each thread draw-off bail 36 is guided by a bar 13*a* secured to the thread guide 13. The pneumatic cylinder 46 is not supported on the carrier 8 but rather is stationary relative to the embroidery head 1. The movement of the carrier 8 causes the thread draw-off lever 36 belonging to the particular injector nozzle 6 that is in alignment with and underneath the thread layer 18 to move with its angled lever 45 above the pneumatic cylinder 46. However, it is also conceivable for one pneumatic cylinder 46 to be provided for each thread draw-off bail 36. However, this unnecessarily increases the technical expense.

In FIG. 11, the thread tensioner 15 is shown by means of an exploded view. The holder 50 of the thread tensioner 15 is secured to the carrier 8, which in turn is movable by means of the drive mechanism 9. The thread tensioners 37, 38 are supported on the holder 50 by means of bolts 55, 55*a*. The thread tensioner 37 comprises a bolt 55, which is supported in a corresponding bore of the holder plate 50. tension disks 56, between which the embroidery thread 10 is guided, are located on the bolt. The tension disks 56 are pressed against one another by means of a cone spring. The contact pressure of the cone spring 57 can be adjusted by means of a rotation controller 59, which can be screwed by a thread onto the bolt 55.

The second thread tensioner 38 likewise has a bolt 55*a*, which is supported in a corresponding bore 50*a* of the holder plate 50. However, this bolt 55*a* has an axial bore through which a pin 53 extends. With one end, the pin 53 strikes a disk 60, and with its other end it strikes a pressure plate 54. By means of a rotatably supported eccentric disk 51, which is rotatable via a drive rod 52, the pressure plate 54 is moved in the direction of the pin 53. The pin 53 is acted upon by pressure from the pressure plate 54 and displaced in the direction of the disk 60. As a result, the compression spring 57, which presses the two tension disks 56 against one another, is in turn compressed, and as a result the tension disks 56 are no longer pressed against one another, and the tension disks 56 no longer clamp or exert pressure upon the embroidery thread 10 passed between them. In the case of the second thread tensioner 38 as well, the contact pressure on the tension disks 56 can be adjusted by means of the rotation controller 59, which can again be screwed onto the bolt 55*a* via a thread.

What is claimed is:

1. An embroidery machine for embroidering embroidery fabric (23), comprising an embroidery head (1), which is located above the embroidery fabric (23), and an embroidery needle (2) which is movably supported in the embroidery head (1) in such a way that by means of drive mechanisms (9), the embroidery needle (2) is movable up and down and is also rotatable about its longitudinal axis, a stitch plate (3) which is located below the embroidery fabric (23) and on which at least some of the embroidery fabric (23) rests during embroidering, and located on the side of the stitch plate (3) remote from the embroidery fabric (23) is a thread layer (18) by which the embroidery thread (10) to be used in stitching is guided, and by rotation of the thread layer (18), the embroidery thread (10) is laid around the embroidery needle (2) that has pierced the embroidery fabric (23), and a cutting tool (19, 20) is provided by means of which the embroidery thread (10) can be severed, characterized in that on the side of the thread layer (18) remote from the embroidery fabric (23), a plurality of injector nozzles (8) that blow compressed air are provided, and by means of the compressed air stream one embroidery thread (10) is inserted at a time into the thread layer (18), and the injector nozzles (6) are movable relative to the thread layer (18) by means of a drive mechanism (9) in such a way that a respective blower opening (24*a*) of an injector nozzle (6) is aligned with the opening of the thread layer (18) toward the injector nozzle (6).

2. The embroidery machine of claim 1, wherein the injector nozzles (6) are arranged in a row or in a grid.

3. The embroidery machine of claim 1, wherein the injector nozzles (6) are secured to a carrier (8, 40), and the carrier (8, 40) is movable in at least one direction by means of at least one of said drive mechanisms (9).

4. The embroidery machine of claim 1, wherein the blower openings (24*a*) of the injector nozzles (6) are all located in the same plane.

5. The embroidery machine of claim 1, wherein a respective blower tube (24) forms the blower opening (24*a*) of each injector nozzle (6), and a suction tube (25) protrudes by one end at least part way into the opening of the blower tube (24) remote from the thread layer (18), and the outside diameter of the suction tube (25) is smaller than the inside diameter of the blower tube (24), the suction tube (25) and blower tube (24) being located in a nozzle base body (26).

6. The embroidery machine of claim 5, wherein the nozzle base body (26) rests sealingly on both an outer jacket face of the suction tube (25) and also on an outer jacket face of the blower tube (24) and, between said faces, forms a chamber (27) into which air can be blown by means of a conduit (28).

7. The embroidery machine of claim 6, wherein the nozzle base body (26) rests on the outer jacket face of the blower tube (24) as far as the opening of the blower tube (24) remote from the thread layer (18), and the chamber (27) extends over a portion of the suction tube (25), and communication exists between the interior of the blower tube (24) and the chamber (27).

8. The embroidery machine of claim 1, further comprising a conduit (28) which supplies said injector nozzles and communicates with a compressed air tank, and wherein compressed air is blown intermittently into the conduit (28) by means of a controllable valve (7) located between the conduit and the tank.

9. The embroidery machine of claim 1, wherein the inside diameter of the suction tube (25) is only slightly larger than the diameter of the embroidery thread (10).

10. The embroidery machine of claim 1, wherein means (11) for monitoring the embroidery thread (10) are located upstream of an opening of the suction tube (25) remote from the blower tube (24).

11. The embroidery machine of claim 10, wherein the monitoring means (11) has a pivotable bail (31, 31'), which is pivoted or deflected out of its position of repose by the embroidery thread (10).

12. The embroidery machine of claim 11, wherein the bail (31) is pivoted by means of a spring or by its own weight into the position of repose, and in the position of repose exerts pressure on a bearing point (34*a*).

13. The embroidery machine of claim 12, wherein an embroidery thread (10) is located between said pivotable bail (31), in its position of repose, and said bearing point (34*a*) is held in its position by the contact pressure of the bail (31).

14. The embroidery machine of claim 13, wherein the embroidery thread (10), held in position by the bail (31), pivots the bail (31) out of its position of repose as soon as the embroidery thread (10), by the injector nozzle (6), has been aspirated by the suction tube (25) or has been blown out of the blower tube (24) or stitched.

15. The embroidery machine of claim 14, wherein a sensor (33) ascertains the position of the bail (31) and transmits it to a controller of the embroidery machine.

16. The embroidery machine of claim 15, wherein by means of the bail (31) and the position sensor (33), it is ascertained whether the embroidery thread (10) is being stitched or aspirated by the injector nozzle (6) and blown out, in other words is under tensile strain, or if the embroidery thread (1) has broken, and wherein, if thread breakage is detected, said controller stops the embroidery machine.

17. The embroidery machine of claim 1, wherein the embroidery thread (10) is drawn from a bobbin (16) by means of a thread draw-off device (14) and, by means of the thread draw-off device (14), predeterminable lengths of the embroidery thread are drawn from the bobbin (16).

18. The embroidery machine of claim 17, wherein located between the thread draw-off device (14) and the bobbin (16) is at least one thread tensioner (15), by means of which the embroidery thread (10) can be clamped with a predeterminable contact pressure, such that the embroidery thread (10) can be drawn through the thread tensioner (15) only beyond a certain tensile force.

19. The embroidery machine of claim 18, wherein the thread tensioner (15) has two tension disks (56), between which the embroidery thread (10) is guided, and the tension disks (56) can be pressure-actuated toward one another by means of a spring (57), and that by means of an adjusting mechanism (51, 52, 53, 54, 60), the spring force can be cancelled, such that the embroidery thread (10) guided between the tension disks (56) is not pressure-actuated by the tension disks (56).

20. The embroidery machine of claim 18, wherein between the thread draw-off device (14) and the bobbin (16), there are two thread tensioners (37, 38), a first one of said thread tensioner (37), by means of its tension disks (56), always acting upon the embroidery thread (10) with an adjustable contact pressure, and wherein the second thread tensioner (38), serves to cancel spring force, by means of an adjusting mechanism (51, 52, 53, 54, 60), such that the embroidery thread (10) guided between the tension disks (56) is not pressure-actuated by the tension disks (56).

21. The embroidery machine of claim 1, further comprising a thread draw-off device (14) which has a draw-off bail (36), pivotable into predeterminable positions, and on pivoting out of an outset position, the draw-off bail (36) draws the embroidery thread (10) from the bobbin (16) in accordance with the pivoting motion.

22. The embroidery machine of claim 1, wherein, by means of a thread draw-off device (14), the embroidery thread (10), severed from the embroidery fabric (23) by the cutting tool (19, 20), can be pulled out of the thread layer (18) in such a way that the embroidery thread (10) is arrested by means of a thread tensioner (15), and by the pivoting motion of a draw-off bail (36), the end (10*a*) of the embroidery thread (10) that is connected to the embroidery thread (10) wound onto the bobbin (16) is located, after being pulled out, in the region of the blower opening (24*a*) of the injector nozzle (6).

23. The embroidery machine of claim 1, wherein each injector nozzle (6) is operatively associated with one valve (7), one monitoring means (11), one thread draw-off device (14), at least one thread tensioner (15), and one bobbin holder (17).

24. The embroidery machine of claim 23, wherein the injector nozzles (6), the monitoring means (11), the thread tensioner (15) and the bobbin holder (17) are secured on a carrier (8), and the carrier (8) is movable by the drive mechanism (9) relative to the thread layer (18) in such a way that each injector nozzle (6) is selectively movable to beneath the thread layer (18), where it is aligned therewith.

25. The embroidery machine of claim 1, further comprising a sensor (33), for detecting the position of the bail (31, 31') of the monitoring means (11), which is stationary, relative to the thread layer (18), and the sensor (33) ascertains the position of the bail (31) of the applicable monitoring means (11) that belongs to the injector nozzle (6) that has moved into alignment with the thread layer (18).

26. The embroidery machine of claim 1, wherein each valve (7) is controllable individually.

27. The embroidery machine of claim 1, further comprising a manually actuatable signal-producing means for actuating said valve (7).

28. The embroidery machine of claim 27, wherein the valve (7) opens for a predeterminable time interval, independently of any manual actuation of the signal-producing means.

29. The embroidery machine of claim 1, wherein additional detection sensors, are provided, which transmit a corresponding detection signal to a controller of the embroidery machine as soon as the embroidery thread (10) is detected, and one additional detection sensor monitors the blower opening (24*a*) of the injector nozzle (6).

30. A method of changing embroidery thread (10) in the embroidery machine of claim 1, comprising the steps of:

providing an embroidery machine as recited in claim 1, drawing off from a bobbin (16), using a thread draw-off device (14), an instantaneously stitched embroidery thread (10) whose length is equal to the length of a travel route from a cutting position C to a needle penetration position A;

severing said instantaneously stitched embroidery thread (10) underneath stitch plate (3) using a cutting tool (19, 20);

drawing said instantaneously switched embroidery thread (10) out of the thread layer (18) by the thread draw-off device (14), the embroidery thread (10) being arrested during this time by the thread tensioner (15), pivoting a thread draw-off bail (36) of the thread draw-off device (14) to thereby position the end (10*a*) of the embroidery thread which is connected to the embroidery thread (10) wound up onto the bobbin (16), after being pulled out, near a blower opening (24*a*) of the injector nozzle (6) in a readiness position B;

moving, by means of a drive mechanism (9), a carrier (8) such that the opening (24*a*) of the particular injector nozzle (6), in which a next embroidery thread (10) to be stitched is located, is in alignment with the lower opening of the thread layer (18);

blowing said next embroidery thread (10) to be stitched into the thread layer (18) by means of an associated injector nozzle (6) in such a manner that the end (10*a*) of the embroidery thread (10) passes through the opening (3*b*) of the stitch plate (3), which opening is in alignment with the eccentric opening (18*a*) of the thread layer (18), thereby positioning said end of the thread between the stitch plate (3) and the embroidery fabric (23), in a needle penetration position A.

31. A method of introducing embroidery thread (10) into an injector nozzle (6) of the embroidery machine of claim 1, comprising the steps of providing an embroidery machine as recited in claim 1, passing the embroidery thread (10) between the bearing point (34*a*) and the bail (31) of the monitoring means (11), in such a way that the end (10*a*) of the embroidery thread (10) is in the vicinity of the aspiration opening of the suction tube (25);

opening, by means of a signal-producing means, the valve (7) of the associated injector nozzle (6), and generating, by means of air flowing into the injector nozzle (6), a negative pressure in the suction tube (25), thereby aspirating the embroidery thread (10) into the suction tube (25) to reach the inside of the blower tube (24) and subsequently pass out of the blower tube (24, 24*a*), the valve (7) being opened until such time as the embroidery thread (10), with its end (10*a*), has left the blower opening (24*a*) of the injector nozzle (6).

* * * * *